US009931545B1

(12) United States Patent
Calcaterra

(10) Patent No.: US 9,931,545 B1
(45) Date of Patent: Apr. 3, 2018

(54) TENNIS BALL RETAINING AND DISPENSING APPAREL

(71) Applicant: Gaia Calcaterra, Fort Lauderdale, FL (US)

(72) Inventor: Gaia Calcaterra, Fort Lauderdale, FL (US)

( * ) Notice: Subject to any disclaimer, the term of this patent is extended or adjusted under 35 U.S.C. 154(b) by 72 days.

(21) Appl. No.: 14/559,247

(22) Filed: Dec. 3, 2014

Related U.S. Application Data

(60) Provisional application No. 61/911,152, filed on Dec. 3, 2013.

(51) Int. Cl.
*A63B 47/00* (2006.01)

(52) U.S. Cl.
CPC ..... *A63B 47/001* (2013.01)

(58) Field of Classification Search
CPC ..... A63B 47/02; A63B 47/007; A63B 47/001
See application file for complete search history.

(56) References Cited

U.S. PATENT DOCUMENTS 487,556 A * 12/1892 Dudley ..... A01C 11/00 2/94
1,426,450 A * 8/1922 Baker ..... F16D 51/22 188/206 A
1,814,887 A * 7/1931 Bender ..... A41F 9/002 224/247
2,304,235 A * 12/1942 Boots ..... A61F 5/56 116/1
2,537,701 A * 1/1951 Previdi ..... A41D 27/20 2/250
2,864,541 A * 12/1958 Altick ..... A41D 13/0012 2/102
2,970,316 A * 2/1961 Silin ..... A41D 11/00 2/94
3,263,806 A * 8/1966 Ring ..... B65D 81/3834 206/139
3,744,059 A * 7/1973 Hayes ..... A41D 27/20 2/250
3,836,143 A * 9/1974 Trent ..... A63B 47/001 124/79
4,042,156 A * 8/1977 Knight ..... A63B 47/001 206/315.9
4,079,871 A * 3/1978 Sica ..... A63B 47/001 2/247
4,088,251 A * 5/1978 Rodriguez ..... A63B 47/001 206/315.9
4,299,345 A * 11/1981 Lanzl ..... A63B 47/001 221/309

(Continued)

*Primary Examiner* — Richale Quinn
(74) *Attorney, Agent, or Firm* — Mark D. Bowen; Malin Haley DiMaggio & Bowen, P.A.

(57) ABSTRACT

A sports apparel top is adapted with an integral generally tubular, flexible sleeve affixed for holding and dispensing tennis balls. The sleeve defines first end forming a ball-receiving inlet disposed at the shoulder portion of the apparel, and a second end forming a ball-dispensing outlet disposed at the side of the apparel proximal the wearer's waistline. This configuration allows a tennis player to insert tennis balls into the sleeve inlet, and to retrieve tennis balls from the sleeve outlet using his/her free left hand. The sleeve may further be adapted with external loops that may be employed to hold a tennis racket by insertion of the handle end therein.

12 Claims, 4 Drawing Sheets

(56) References Cited

U.S. PATENT DOCUMENTS 4,413,762 A * 11/1983 Carini ..... A45F 5/02 206/315.9
4,416,404 A * 11/1983 Daniels ..... A63B 47/001 206/315.9
4,433,803 A * 2/1984 Liberboim ..... A63B 47/001 224/251
4,522,438 A * 6/1985 Logue ..... A63B 47/02 221/306
4,603,441 A * 8/1986 Richter ..... A41D 13/0017 2/211
4,798,319 A * 1/1989 James, Jr. ..... A63B 47/001 224/196
4,843,649 A * 7/1989 Jewell ..... F42B 39/02 2/94
5,064,107 A * 11/1991 Ascarrunz ..... A63B 47/001 224/247
5,086,948 A * 2/1992 Slusarz ..... A47F 1/082 221/185
5,127,565 A * 7/1992 Grant ..... A41D 13/0012 2/102
5,292,161 A * 3/1994 Green ..... A63B 47/02 206/315.9
5,704,531 A * 1/1998 Nam ..... A63B 47/001 224/235
5,724,679 A * 3/1998 Hans ..... A41D 27/20 2/228
5,833,091 A * 11/1998 Palmer ..... A63B 47/002 221/256
5,940,883 A * 8/1999 Daoust ..... A41D 13/0012 2/102
6,053,386 A * 4/2000 Reynolds ..... A63B 47/001 221/185
6,216,933 B1 * 4/2001 Healy ..... A63B 47/001 224/663
6,719,340 B2 * 4/2004 Imig ..... A63B 47/02 294/19.2
6,993,940 B2 * 2/2006 Rabinowicz ..... A41D 13/0015 2/250
7,000,255 B1 * 2/2006 Baacke ..... A41D 3/00 2/94
8,015,975 B2 * 9/2011 Zohlmann, Jr. ..... A61F 5/56 128/848
8,028,345 B2 * 10/2011 Waite ..... A41D 1/14 2/220
8,484,763 B1 * 7/2013 Lucas ..... A41C 3/0057 2/247
2001/0015208 A1 * 8/2001 Konishi ..... A61F 5/56 128/848
2006/0230491 A1 * 10/2006 Levy ..... A41D 27/00 2/77

* cited by examiner

TENNIS BALL RETAINING AND DISPENSING APPAREL

CROSS REFERENCE TO RELATED APPLICATIONS

This application claims the benefit of provisional U.S. Patent Application Ser. No. 61/911,152, filed on Dec. 3, 2013.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention generally relates to sports apparel and sports apparatus adapted for retaining and selectively dispensing sports balls, such as tennis balls, racket balls and the like.

2. Description of Related Art

A variety of sports incorporate the use of balls during play such as tennis, racket ball, golf, ping pong etc. It is often desirable for one participating in such sports to carry more than one ball. Usually, the player is forced to carry spare balls in his/her pockets which often are not well suited for the task and can prove to be uncomfortable carrying options.

One such sport where carrying at least one spare ball is a routine requirement is tennis. Tennis is a popular sport that is enjoyed around the world by participants both young and old. Tennis is played by millions of recreational players and is also a popular worldwide spectator sport. The sport is usually played individually against a single opponent ("singles"), or between two teams of two players each ("doubles").

Tennis players often store tennis balls in their pockets for convenient retrieval during play. Pants pockets, however, are not optimally designed to conveniently store spherical objects such as tennis balls. Accordingly, placing the tennis balls into one's pocket and removing same can be awkward and difficult. As a result, various devices have been developed to assist tennis players in storing tennis balls during the course of play. For example, U.S. Pat. No. 4,079,871, issued to Sica, discloses a pouch structure worn about the waist of a player to provide additional pocket capacity for storing tennis balls. Similarly, U.S. Pat. No. 4,603,441, issued to Richter, discloses a waist-worn sport garment having first and second pockets each sized to receive a plurality of tennis balls therein. U.S. Pat. No. 8,028,345, issued to Waite, discloses a fabric tennis garment worn about the waist and forming a ball sleeve structured so that tennis balls may be inserted from above or below the sleeve.

In addition, others have developed back-pack style devices for storing and dispensing tennis balls. For example, U.S. Pat. No. 4,088,251, issued to Rodriquez, discloses a rigid tubular ball device which mounts upon the back of a tennis player and includes a tennis ball dispensing outlet disposed at the bottom thereof. U.S. Pat. No. 5,086,948, issued to Slusarz, discloses a tennis ball backpack for dispensing tennis balls. U.S. Pat. No. 6,053,386, issued to Reynolds, discloses a back-mounted serpentine tube for receiving, storing, and dispensing tennis balls.

The above-referenced devices suffer from a number of limitations and disadvantages that have prevented widespread commercial acceptance. Such limitations and disadvantages include providing structures that are bulky, excessively heavy, and uncomfortable to wear during play.

Accordingly, there exists a need for advancements in the art of sports apparel adapted for retaining and selectively dispensing sports balls, particularly tennis balls, racket balls, and the like.

BRIEF SUMMARY OF THE INVENTION

The present invention overcomes the limitations and disadvantages in the art by providing sports apparel adapted with integral or accessory structure for retaining and selectively dispensing sports balls, particularly, tennis balls, racket balls and the like. In accordance with a preferred embodiment, a sports garment such as a top or shirt is adapted with an integral generally tubular, flexible sleeve affixed to the back of the garment for holding and dispensing tennis balls. The sleeve defines open top and bottom ends, wherein the top end forms a ball inlet and the bottom end forms a ball outlet. The sleeve is configured and sized to receive sports balls (i.e. tennis balls, racquet balls, etc.) inserted through the inlet, retain the balls during play, and selectively dispense the balls through the outlet. The sleeve is preferably generally diagonally affixed, either permanently or detachably, to the back of the garment with the inlet end disposed at the top right shoulder portion of the garment and the dispensing outlet disposed a the lower left hand side of the gars rent proximal the wearer's waist. This configuration allows a (right handed) tennis player to insert tennis balls into the sleeve inlet, as well as retrieve tennis balls from the sleeve's outlet using his/her free left hand. The outlet is preferably adapted to allow for easy grasping and retrieval of tennis balls while preventing the balls from falling out during play. The sleeve may further be adapted with external loops that may be employed to hold a tennis racket by insertion of the handle end therein. In an alternate embodiment, the sleeve may be separately formed and provided with a strap run through the external loops to allow the sleeve to be strapped about the user's shoulder and waist.

Accordingly, it is an object of the present invention to provide wearable tennis apparel adapted to hold and dispense sports balls, such as tennis balls, racket balls, and the like.

Another object of the present invention is to provide wearable tennis apparel that is lightweight and comfortable.

Still another object of the present invention is to provide a gal, lent system for holding and dispensing sports balls, such as tennis balls, that is unobtrusive so as not to interfere with the tennis swing.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, when a number or a range is recited, ordinary skill in the art understand it intends to encompass an appropriate, reasonable range for the particular field related to the invention. The term "ball" or "balls" shall broadly be construed to mean sports balls, including without limitation, tennis balls, racquet balls, golf balls, baseballs, and soft balls.

Figure 1:
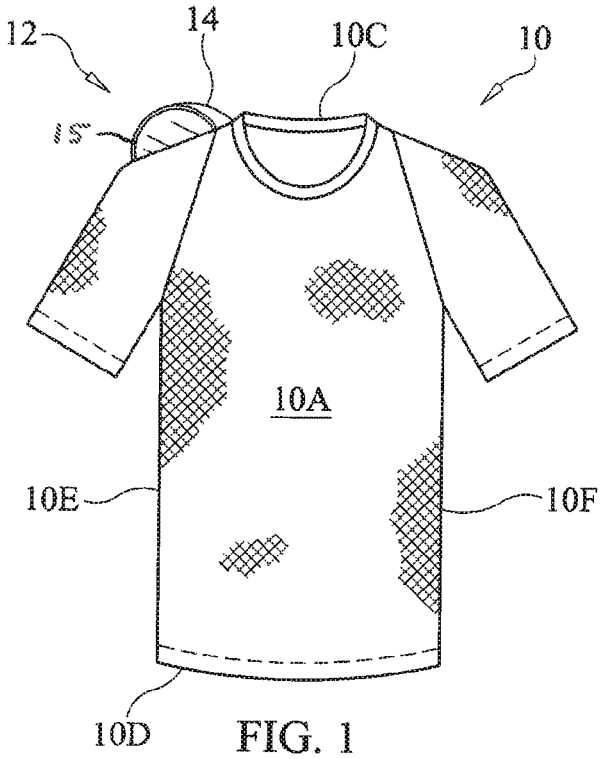
FIG. 1 is a front view illustration of an article of sports apparel adapted with a tennis ball retaining and dispensing sleeve in accordance with a preferred embodiment of the present invention.

With reference now to the drawings, FIGS. 1-6 depict preferred and alternate embodiments of sports apparel adapted for retaining and selectively dispensing sports balls, such as tennis balls, and the like, in accordance with the present invention. The apparel, generally referenced as 10, is adapted with an integral generally tubular, flexible sleeve 12 affixed to the garment for receiving, retaining, and dispensing tennis balls. Sports apparel 10 is preferably an a clothing article such as a shirt or top, and may further comprise a t-shirt, sweatshirt, sweater, pullover or any other suitable apparel or garment. Sports apparel 10 may have sleeves as illustrated in FIG. 1 or may be sleeveless. Sports apparel 10 preferably includes a front, referenced as 10A, a back 10B, an collar 10C, a bottom 10D, a right side 10E, and a left side 10F, As noted above, however, sleeve 12 may be separately formed and adapted for removable affixation to the apparel, or may be adapted for affixation to the user via an adjustable shoulder strap.

Figure 2:
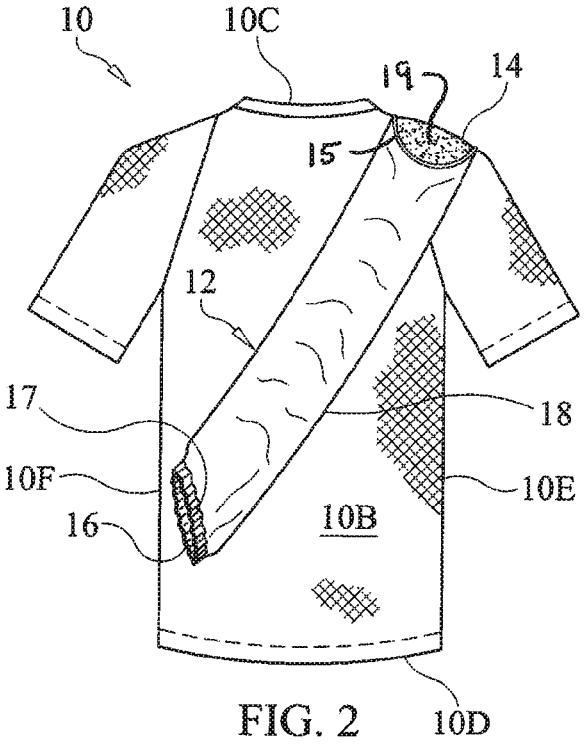
FIG. 2 is a rear view illustration thereof.

FIGS. 1 and 2 are front and rear view illustrations respectively of sports apparel 10 in accordance with the present invention. As noted above, sleeve 12 preferably comprises a generally tubular, flexible sleeve that may be fabricated from natural or synthetic woven or non-woven fabric, mesh of net-like material, or any other suitable material. Sleeve 12 is preferably either permanently affixed to and/or integrated into the apparel (as by sewing or stitching), or alternatively removably affixed with snaps, buttons, zipper or hook and loop fastening material. As best seen in FIG. 2, when configured for use by right-handed wearers, sleeve 12 is preferably affixed to the back 10B of apparel 10 and traverses the back of the apparel from the right shoulder area to a lower, opposing left side portion of the apparel top. As should be apparent, when configured for use by left-handed wearers, sleeve 12 would be preferably affixed to the back 10B of apparel 10 and traverses the back of the apparel from the left shoulder area to a lower, opposing right side portion of the apparel top.

Sleeve 12 has an opposing first and second ends which define a top ball-receiving inlet 14 and bottom ball-dispensing outlet 16, and a main sleeve body 18 extending between inlet 14 and outlet 16. Inlet 14 and outlet 16 are preferably open and/or openable, and suitably sized to receive tennis balls (or other sports balls) inserted into inlet 14 and dispensed through the outlet 16. As should be apparent, sleeve 12 is suitably sized to accommodate sports balls of a particular size and thus would be larger for tennis balls and smaller for racket balls, or even smaller for golf balls.

A significant aspect of the present invention involves providing sleeve inlet 14 with a resilient arcuate member 15 which functions to maintain inlet 14 in an open configuration. When so adapted arcuate member 15 and inlet 14 are capable of pivoting to a forward, ball-insertion configuration as shown in FIG. 1, and rearward, to a stowed configuration wherein inlet 14 generally overlays the wearer's back as shown in FIG. 2. In the configuration shown in FIG. 2, inlet 14 is generally not visible from the front and does not otherwise interfere with the player's head movement or lines of sight. Placing the inlet 14 and outlet 16 as shown in FIG. 2, allows a right-handed tennis player to insert tennis balls into the sleeve inlet 14, and to retrieve tennis balls from the sleeve outlet 16 using his/her free (i.e. non-racket-holding hand) left hand. As should be apparent, tennis balls inserted into the sleeve inlet 14 move downward through the main sleeve body 18 under the influence of gravity, and further aided by player movement, toward the lower disposed outlet 16. To facilitate said movement, sleeve 18 may further include a friction reducing inner liner, referenced as 19. Liner 19 may comprise any suitable material having a low coefficient of static and/or dynamic friction, such as polyester, polypropylene, nylon, plastic, Teflon® (TEFLON is a registered trademark of E.I. DuPont De Nemours and Company), etc.

Outlet 16 is preferably adapted with an opening configured to allow for easy grasping and retrieval of tennis balls while preventing the balls from falling out during play. Accordingly, outlet 16 may include a peripheral edge incorporating an elastic band 17 which functions to restrict the outlet opening so as to prevent tennis balls from inadvertently falling out. Elastic band 17 functions to configure outlet 16 to a normally restricted configuration so as to prevent balls from being inadvertently dispensed from sleeve 12, while expanding in response to a user's hand motion on the exterior of the sleeve to squeeze a ball though outlet 16 for the selective dispensing of a ball. Alternately, resilient fabric of reduced diameter as compared with main sleeve body 18, may function to sufficiently restrict dispensing of sports balls, or any other suitable restrictable and expandable opening structure may be employed.

Figure 3:
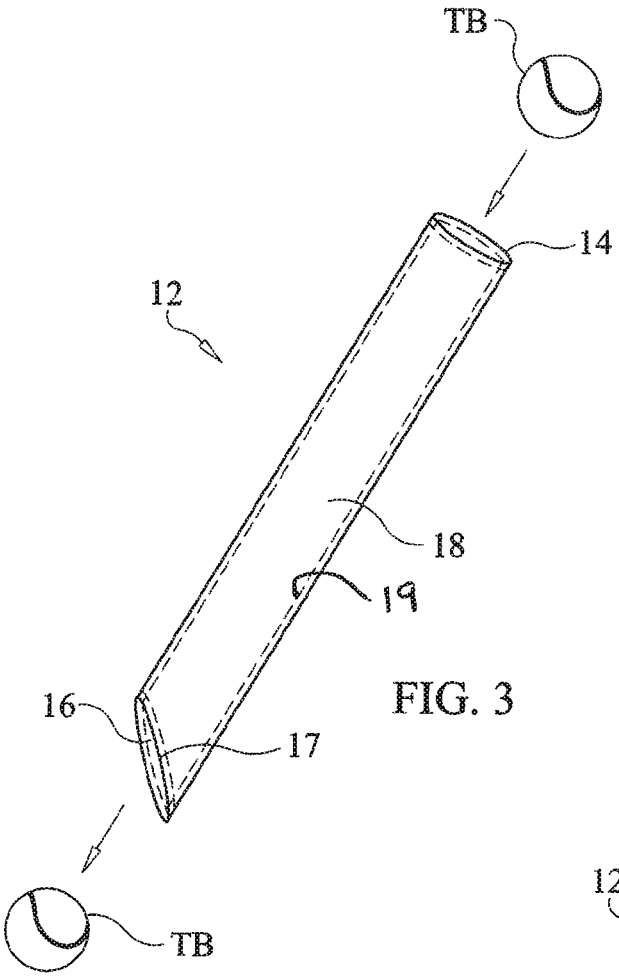
FIG. 3 is a schematic illustration of the tennis ball retaining and dispensing sleeve illustrating the insertion and dispensing of tennis balls.
Figure 4:
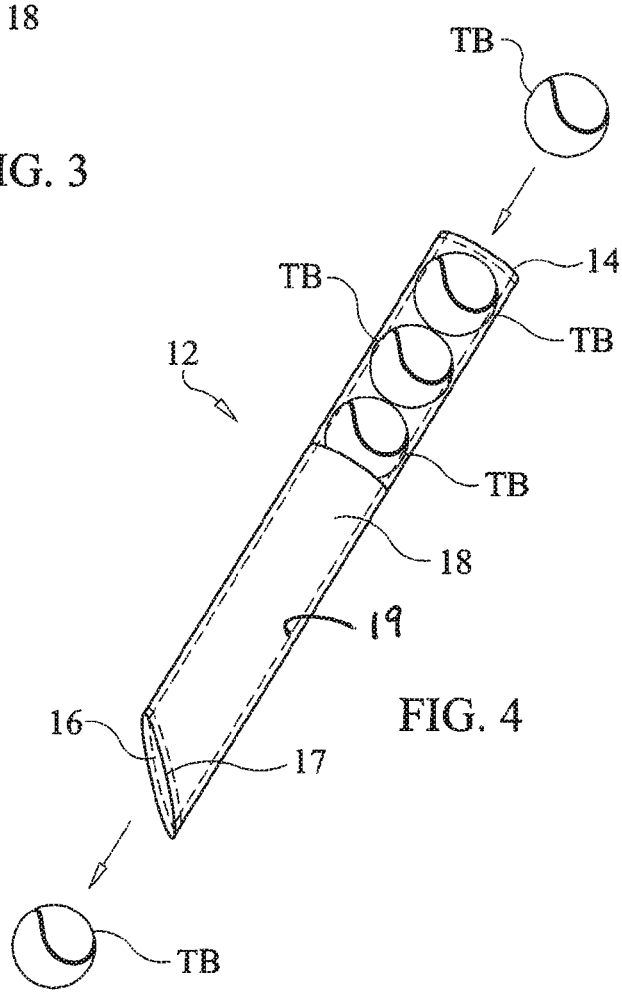
FIG. 4 is a partial sectional view thereof.

FIGS. 3 and 4 provide schematic illustrations demonstrating the use of the tennis ball retaining and dispensing sleeve 12 to receive, retain, and selectively dispense tennis balls, referenced as "TB". Furthermore, FIG. 4 is a partial cutaway view illustrating tennis balls TB held within the main body 18 of sleeve 12. As should be apparent, sleeve 12 is capable of holding a plurality of tennis balls. The number of balls capable of being stored in sleeve 12 will vary depending on the size of the garment (e.g. adult vs. child size), as well as the size of the balls contained therein (e.g. tennis balls vs. racket balls etc.).

Figure 5:
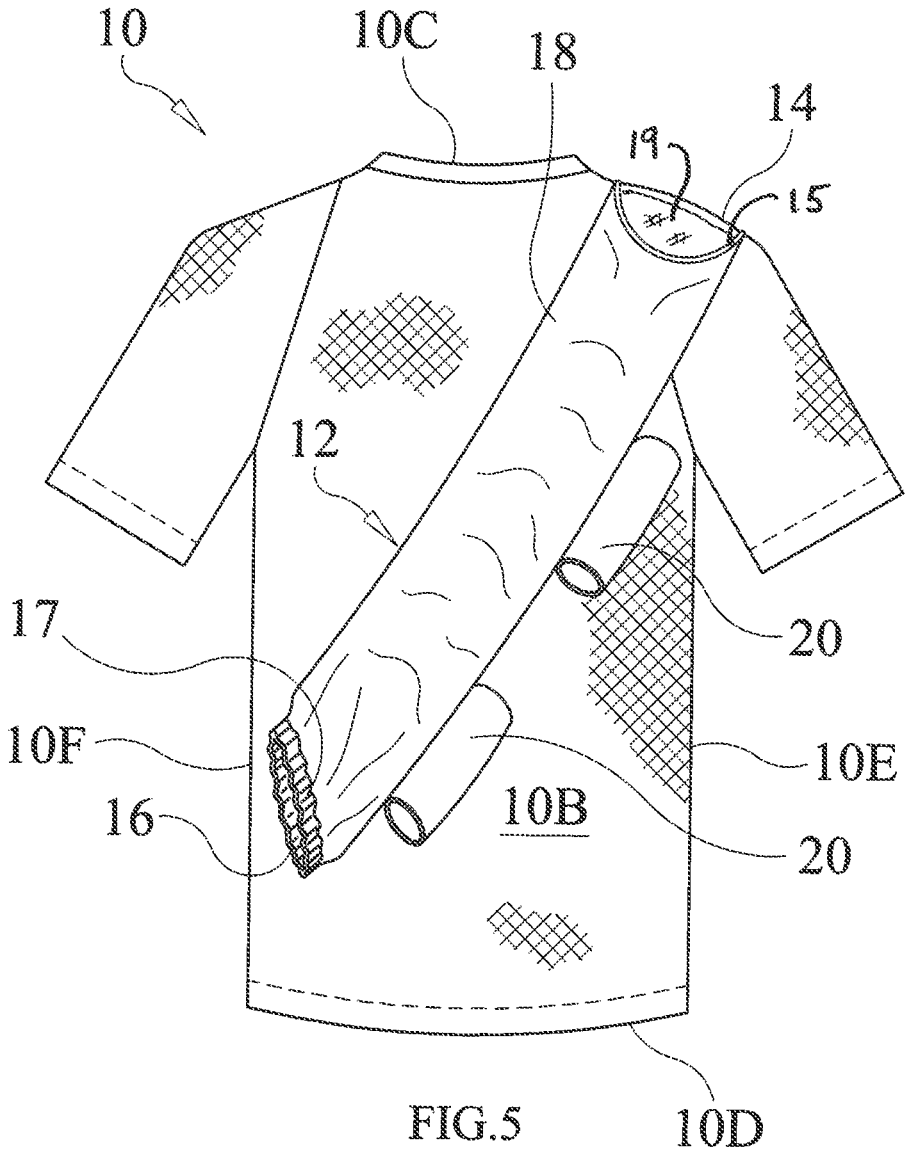
FIG. 5 depicts an alternate embodiment wherein the sleeve is further adapted with loops for holding a tennis racket.
Figure 6:
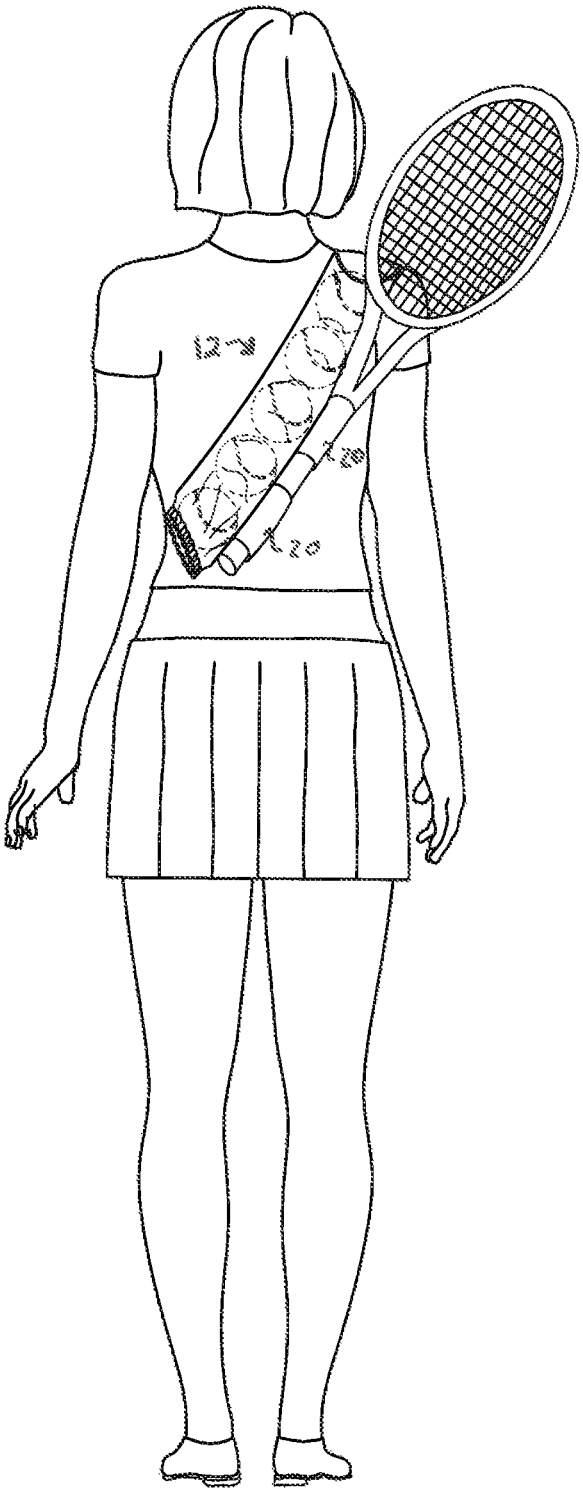
FIG. 6 is an illustration of the embodiment depicted in FIG. 5 with a tennis racquet mounted in a carrying configuration.

FIG. 5 depicts an alternate embodiment wherein sleeve 12 is further adapted with external loops, referenced as 20, that may be employed to hold a tennis racket by insertion of the handle end therein such that the device further functions to hold the tennis racquet before, or after, the match (for walking home, cycling, etc.). FIG. 6 provides a rear view illustration of a tennis racquet carried by sleeve 12 with the racquet handle inserted within loops 20. In still another, alternate embodiment, the sleeve may be separately formed and provided with a strap having ends affixed in proximity to the opposing sleeve ends to allow the sleeve to be strapped about the user's shoulder and waist.

The foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention. The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An article of sports apparel comprising:

an apparel top having a front, a back, a shoulder portion including a collar, a bottom, and left and right sides;

a tubular ball-receiving sleeve fabricated of flexible fabric and affixed by stitching to said apparel diagonally traversing the back of said apparel;

said sleeve having a first end disposed in proximity to said shoulder portion adjacent to said collar, and a second end disposed on a lower, opposing side portion of said apparel;

said sleeve first end defining a ball inlet;

an arcuate resilient member disposed at said first end to maintain said ball inlet in a generally open configuration, said resilient member pivotally movable between a forward, ball insertion configuration wherein said ball inlet projects above said shoulder portion, and a rearward stowed configuration wherein said inlet overlays the back of said apparel top;

said sleeve second end defining a ball outlet;

an elastic member disposed in proximity to said second end to maintain said ball outlet in a normally restricted configuration;

whereby balls inserted into said ball inlet are urged to said ball outlet by gravity such that the balls may be retrieved from said ball outlet by the user.

2. An article of sports apparel according to claim 1, wherein said inlet is disposed in proximity to the right of said collar.

3. An article of sports apparel according to claim 1, wherein said outlet is disposed in proximity to the left side in spaced relation with the bottom of said apparel top.

4. An article of sports apparel according to claim 1, wherein said inlet is disposed in proximity to the left side of said collar.

5. An article of sports apparel according to claim 1, wherein said outlet is disposed in proximity to the right side in spaced relation with the bottom of said apparel top.

6. An article of sports apparel according to claim 1, wherein said sleeve further includes a friction reducing inner liner.

7. In combination with a sports apparel top having a front, a back, a collar, a bottom, and left and right sides, a ball-retaining sleeve is affixed by sewing to the back of said apparel top, said sleeve having a ball-receiving inlet disposed adjacent to said collar on one side of said apparel top, and a ball-dispensing outlet disposed in proximity to the bottom of said apparel top on an opposing side thereof, said inlet including an arcuate resilient member maintaining said inlet in an open configuration and movable between a ball-receiving configuration wherein said inlet projects above said shoulder portion, and a stowed configuration, and said outlet including an elastic member maintaining said outlet in a normally restricted configuration.

8. The combination according to claim 7, wherein said inlet is disposed to the right side of said collar.

9. The combination according to claim 7, wherein said outlet is disposed to the lower left side of said apparel.

10. The combination according to claim 7, wherein said inlet is disposed to the left side of said collar.

11. The combination according to claim 7, wherein said outlet is disposed to the lower right side of said apparel.

12. The combination according to claim 7, wherein said sleeve further includes a friction reducing inner liner.

* * * * *